US011879661B2

(12) United States Patent
Gokhale et al.

(10) Patent No.: US 11,879,661 B2
(45) Date of Patent: Jan. 23, 2024

(54) DYNAMIC TEMPERATURE CONTROL FOR A HEATING, VENTILATION, AND AIR CONDITIONING SYSTEM

(71) Applicant: Lennox Industries Inc., Richardson, TX (US)

(72) Inventors: Umesh Gokhale, Irving, TX (US); Eric Berg, The Colony, TX (US)

(73) Assignee: Lennox Industries Inc., Richardson, TX (US)

( * ) Notice: Subject to any disclaimer, the term of this patent is extended or adjusted under 35 U.S.C. 154(b) by 94 days.

(21) Appl. No.: 17/651,559

(22) Filed: Feb. 17, 2022

(65) Prior Publication Data

US 2023/0258361 A1 Aug. 17, 2023

(51) Int. Cl.

| | |
|---|---|
| ***F24F 11/86*** | (2018.01) |
| ***F24F 11/46*** | (2018.01) |
| ***F24F 11/61*** | (2018.01) |
| ***F24F 11/63*** | (2018.01) |
| ***F24F 140/50*** | (2018.01) |
| ***F24F 110/10*** | (2018.01) |
| ***F24F 130/10*** | (2018.01) |

(52) U.S. Cl.

CPC ..... *F24F 11/86* (2018.01); *F24F 11/46* (2018.01); *F24F 11/61* (2018.01); *F24F 11/63* (2018.01); *F24F 2110/10* (2018.01); *F24F 2130/10* (2018.01); *F24F 2140/50* (2018.01)

(58) Field of Classification Search

CPC .. F24F 11/86; F24F 11/46; F24F 11/61; F24F 11/63; F24F 2110/10; F24F 2130/10; F24F 2140/50

See application file for complete search history.

(56) References Cited

U.S. PATENT DOCUMENTS

| | | | | |
|---|---|---|---|---|
| 2019/0049130 | A1* | 2/2019 | Berg | F25B 49/022 |
| 2019/0331379 | A1* | 10/2019 | Zhang | F25B 39/04 |
| 2020/0026249 | A1* | 1/2020 | Przybylski | G06F 3/04847 |
| 2020/0292200 | A1* | 9/2020 | Li | F24F 11/61 |
| 2021/0211081 | A1* | 7/2021 | Sandoval | H02P 27/085 |

* cited by examiner

*Primary Examiner* — Nelson J Nieves
*Assistant Examiner* — Matthew John Moscola
(74) *Attorney, Agent, or Firm* — Baker Botts L.L.P.

(57) ABSTRACT

A device is configured to operate a Heating, Ventilation, and Air Conditioning (HVAC) system. The device is further configured to receive a temperature value and determine a load demand value based on the temperature value. The device is further configured to determine the load demand value is greater than the load capacity value for the HVAC system and, in response, identify a first setting from among a first plurality of settings for the HVAC system. By default, access to the first plurality of setting for the HVAC system is restricted for a user. The device is further configured to receive a response approving permission to operate the HVAC system using the first setting to the user and send a trigger signal to an HVAC controller to operate the one or more components of the HVAC system using the first setting.

20 Claims, 5 Drawing Sheets

DYNAMIC TEMPERATURE CONTROL FOR A HEATING, VENTILATION, AND AIR CONDITIONING SYSTEM

TECHNICAL FIELD

The present disclosure relates generally to Heating, Ventilation, and Air Conditioning (HVAC) system control, and more specifically to dynamic temperature control for an HVAC system.

BACKGROUND

Heating, ventilation, and air conditioning (HVAC) systems can be used to regulate the temperature of a room or space. In the event of extreme weather changes, a load deficit event can occur. A load deficit event is when the load capacity necessary to maintain a temperature or level of comfort for a space based on the outside temperature exceeds the load capacity of an HVAC system. In this case, the HVAC system may not be able to provide adequate heating or cooling to achieve a desired setpoint temperature for a space. Existing HVAC systems are configured to operate their components within the default or recommended setting value ranges for their components. This configuration ensures the reliability of an HVAC system's components but limits the load capacity of the HVAC system and limits the HVAC system's ability to resolve a load deficit event.

SUMMARY

The disclosed system provides several practical applications and technical advantages that overcome the previously discussed technical problems. The following disclosure provides a practical application of a temperature control device for a heating, ventilation, and air conditioning (HVAC) system. The disclosed temperature control device provides practical applications that improve the resource utilization of the components of an HVAC system. The temperature control device is generally configured to dynamically control the operation of the HVAC system by using either standard mode settings or boost mode settings based on whether a load deficit event has been detected. In the standard mode, the temperature control device is configured to operate the components of an HVAC system using setting values that are within the default or recommended value ranges for its components. In the boost mode, the temperature control device is configured to operate one or more components of the HVAC system using setting values that exceed the default or recommended value ranges for its components. This process allows the temperature control device to selectively operate the HVAC system in a boost mode for a short duration of time to compensate for a load deficit that is caused by a significant difference between a current or forecasted temperature and a desired setpoint temperature for a space. Without the boost mode, the HVAC system may not be able to provide adequate heating or cooling to achieve a desired setpoint temperature. This process provides improves resource utilization by dynamically operating an HVAC system between a standard mode and a boost mode which improves the overall performance of the HVAC system.

In one embodiment, the system comprises a temperature control device that is configured to receive a temperature value and determine a load demand value based on the temperature value. The temperature control device is further configured to determine the load demand value is greater than the load capacity value for the HVAC system and, in response, identify a first setting from among a first plurality of settings for the HVAC system. By default, access to the first plurality of setting for the HVAC system is restricted for a user. The temperature control device is further configured to receive a response approving permission to operate the HVAC system using the first setting to the user and send a trigger signal to an HVAC controller to operate the one or more components of the HVAC system using the first setting.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

System Overview

Figure 1:
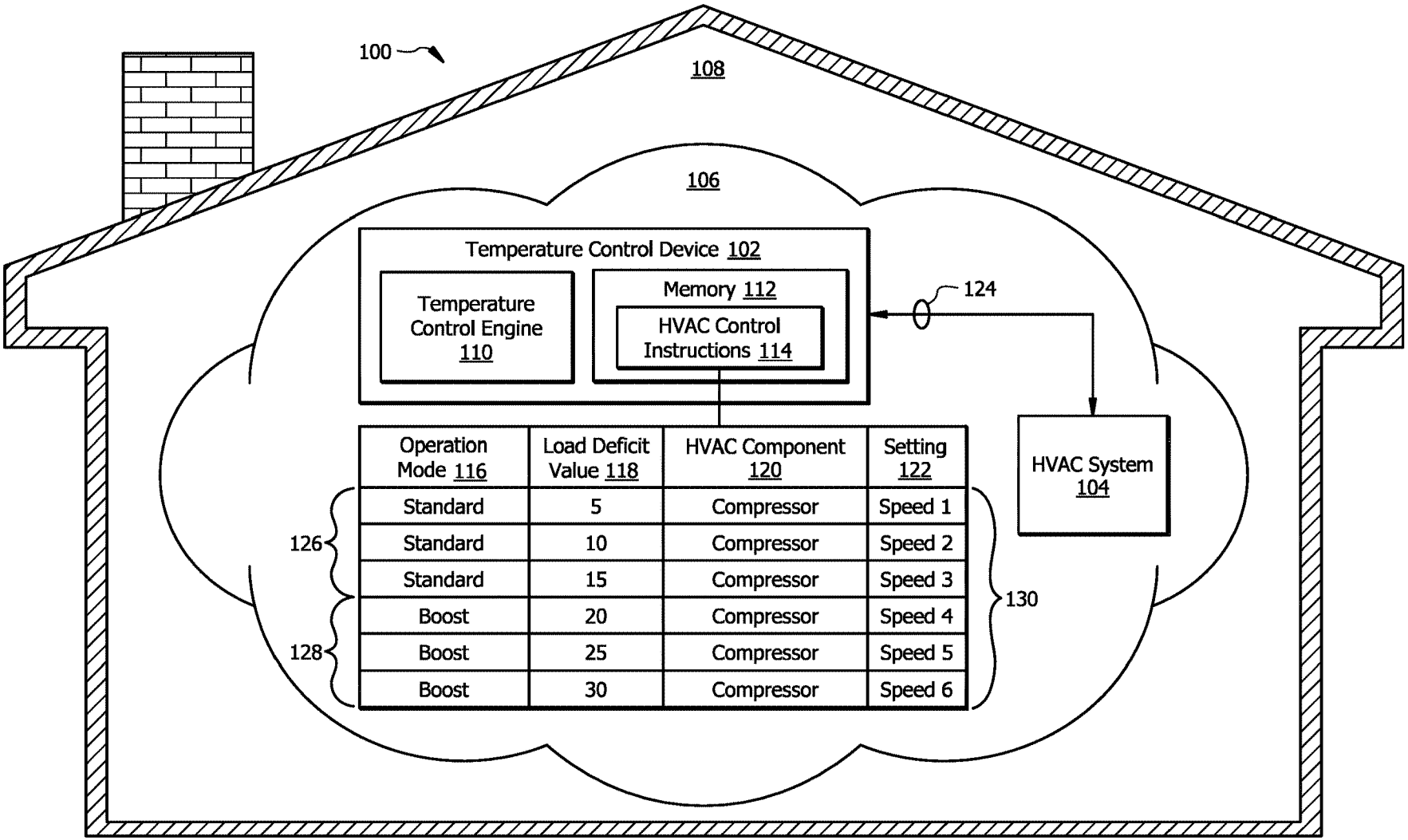
FIG. 1 is a schematic diagram of an embodiment of a control system for an HVAC system.

FIG. 1 is a schematic diagram of an embodiment of a control system 100 for heating, ventilation, and air conditioning (HVAC) systems 104. The control system 100 is generally configured to dynamically control the operation of the HVAC system 104 by using either standard mode settings 122 or boost mode settings 122 based on whether a load deficit event has been detected. A load deficit event indicates that the load capacity required to maintain a temperature or level of comfort for a space 108 based on the outside temperature exceeds the load capacity of the HVAC system 104. In the standard mode 126, the HVAC system 104 is configured to operate its components using setting values that are within the default or recommended value ranges for its components. In the boost mode 128, the HVAC system 104 is configured to operate one or more of its components using setting values that exceed the default or recommended value ranges for its components. This process allows the control system 100 to selectively operate the HVAC system 104 in a boost mode 128 for a short duration of time to compensate for a load deficit that is caused by a significant difference between a current or forecasted temperature and a desired setpoint temperature for a space 108. Without the boost mode 128, the HVAC system 104 may not be able to provide adequate heating or cooling to achieve a desired setpoint temperature. The boost mode 128 may be offered sparingly or selectively since the boost mode 128 involves operating components of the HVAC system 104 using setting values outside of their recommend setting values which can cause additional wear and tear on the components and reduce their lifespan. For this reason, the boost mode 128 is not always available to users.

In one embodiment, the control system 100 comprises a temperature control device 102 and an HVAC system 104 that are in signal communication with each other within a network 106. Network 106 allows communication between and amongst the various components of the control system 100. This disclosure contemplates network 106 as being any suitable network operable to facilitate communication between the components of the control system 100. Network 106 may include any interconnecting system capable of transmitting signals, data, messages, or any combination of the preceding. Network 106 may include all or a portion of a local area network (LAN), a wide area network (WAN), an overlay network, a software-defined network (SDN), a virtual private network (VPN), a packet data network (e.g., the Internet), a mobile telephone network (e.g., cellular networks, such as 4G or 5G), a Plain Old Telephone (POT) network, a wireless data network (e.g., WiFi, WiGig, WiMax, etc.), a Long Term Evolution (LTE) network, a Universal Mobile Telecommunications System (UMTS) network, a peer-to-peer (P2P) network, a Bluetooth network, a Near Field Communication (NFC) network, a Zigbee network, and/or any other suitable network.

HVAC System

An HVAC system 104 is generally configured to control the temperature of a space 108. Examples of a space 108 include, but are not limited to, a room, a home, an apartment, a mall, an office, a warehouse, or a building. The HVAC system 104 may comprise the temperature control device 102 (e.g. a thermostat), a furnace, compressors, heat pumps, fans, blowers, evaporators, condensers, and/or any other suitable type of hardware for controlling the temperature of the space 108. An example of an HVAC system 104 configuration and its components are described in more detail below in FIGS. 4 and 5. Although FIG. 1 illustrates a single HVAC system 104, a location or space 108 may comprise a plurality of HVAC systems 104 that are configured to work together. For example, a large building may comprise multiple HVAC systems 104 that work cooperatively to control the temperature within the building.

Temperature Control Device

The temperature control device 102 is generally configured to send trigger signals 124 to the HVAC system 104 to control the operation of the HVAC system 104 via an HVAC controller (e.g. an Integrated Furnace Controller (IFC) 402 or an outdoor unit controller 548). In one embodiment, the temperature control device 102 is configured to operate the HVAC system 104 using settings 122 that correspond with a default or standard mode 126 when a load deficit event has not been detected. In the standard mode 126, the HVAC system 104 is configured to operate its components using setting values that are within the default or recommended value ranges for its components. The temperature control device 102 is further configured to operate the HVAC system 104 using settings 122 that correspond with a boost mode 128 when a load deficit event has been detected. By default, access to the boost mode settings 122 are restricted from users. In other words, users are not able to access or use boost mode settings 122 unless a load deficit event has been detected. In the boost mode 128, the HVAC system 104 is configured to operate one or more of its components using setting values that exceed the default or recommended value ranges for its components. Operating components of the HVAC system 104 using setting values outside of their recommend setting values can cause additional wear and tear on the components and reduce their lifespan. For this reason, the boost mode 128 is not always available to users and is only available for a short predetermined amount of time. In some embodiments, the boost mode 128 may only be offered to users for a predetermined amount of time within a given time period. For example, the boost mode 128 may only be offered three times within a one month period. In other examples, the boost mode 128 may be offered any other suitable amount of time and within any other suitable period of time. An example of the temperature control device 102 in operation is described below in FIG. 2.

In one embodiment, the temperature control device 102 comprises a temperature control engine 110 and a memory 112. The temperature control device 102 may further comprise a graphical user interface, a display 308, a touch screen, buttons, knobs, or any other suitable combination of components. Additional details about the hardware configuration of the temperature control device 102 are described in FIG. 3. The temperature control engine 110 is generally configured to control the operation of the HVAC system 104 by sending trigger signals 124 to operate the HVAC system 104 using settings from either a standard mode 126 or a boost mode 128 based on the current load demand for the HVAC system 104. An example of the temperature control engine 110 in operation is described in FIG. 2.

The memory 112 is configured to store HVAC control instructions 114 and/or any other suitable type of data. The HVAC control instructions 114 generally comprise settings 122 for controlling the operating of components of the HVAC system 104. More specifically, the HVAC control instructions 114 comprises a plurality of settings 122 for operating the components of the HVAC system 104 in a default or standard mode 126 and a plurality of settings 122 for operating the components of the HVAC system 104 in a boost mode 128. In one embodiment, the HVAC control instructions 114 comprises a plurality of entries 130 that each correspond with a setting 122 for one or more components of the HVAC system 104. As an example, each entry 130 may identify an operation mode 116, a load deficit value 118, an HVAC component identifier 120, and a value for a setting 122. The operation mode 116 indicates whether the setting value corresponds with a standard mode 126 or a boost mode 128 of operation. The load deficit value 118 may indicate a value that can be used to identify the correct setting value when a load deficit event is detected. For example, the load deficit value 118 may indicate a difference between a load demand value based on the outside temperature and a load capacity value for the HVAC system 104. In other examples, the load deficit value 118 may correspond with any other suitable type of value. The HVAC component identifier 120 identifies a component of the HVAC system 104 that corresponds with the setting value. Examples of HVAC components include, but are not limited to, compressors, heat pumps, indoor blowers, outdoor fans, or any other controllable device of the HVAC system 104. The setting values identify a parameter value that is used to control the operation of a component of the HVAC system 104. The settings value may correspond with a fan speed, a flow rate, or any other suitable type of setting.

Temperature Control Process

Figure 2:
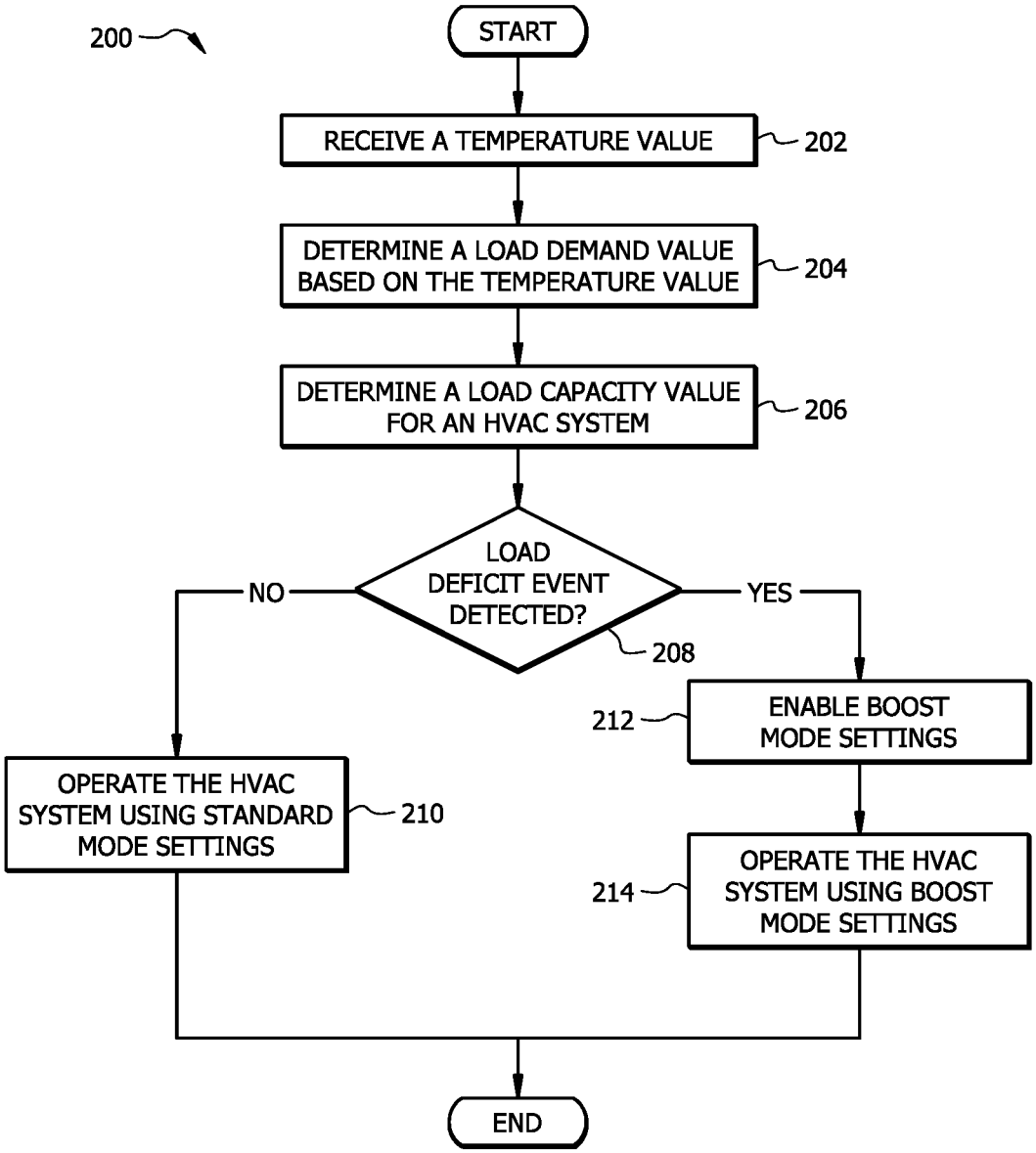
FIG. 2 is a flowchart of an embodiment of a temperature control process for an HVAC system.

FIG. 2 is a flowchart of an embodiment of a temperature control process 200 for an HVAC system 104. The control system 100 may employ process 200 to dynamically control the operation of the HVAC system 104 by using either standard mode settings 122 or boost mode settings 122 based on whether a load deficit event has been detected. This process allows the control system 100 to selectively operate the HVAC system 104 in a boost mode 128 for a short duration of time to compensate for a load deficit that is caused by a significant difference between a current or forecasted temperature and a desired setpoint temperature for a space 108. Without the boost mode 128, the HVAC system 104 may not be able to provide adequate heating or cooling to achieve a desired setpoint temperature. The boost mode 128 is offered sparingly or selectively since the boost mode 128 involves operating components of the HVAC system 104 using setting values outside of their recommend setting values which can cause additional wear and tear on the components and reduce their lifespan.

At operation 202, the temperature control device 102 receives a temperature value. The temperature value may correspond with a current outside temperature value or a forecasted temperature value. For example, the temperature control device 102 may use a temperature sensor to determine a current outside temperature value. As another example, the temperature control device 102 may receive a current outside temperature value or a forecasted temperature value from a remote server or a third-party server. As another example, the temperature control device 102 may use a machine learning model or neural network to determine a forecasted temperature value. In other examples, the temperature control device 102 may receive a current outside temperature value or a forecasted temperature value from any other suitable source.

At operation 204, the temperature control device 102 determines a load demand value based on the received temperature value. In one embodiment, the temperature control device 102 may determine a load demand value based on the temperature value that was received in operation 202 and a desired setpoint temperature for a space 108. The setpoint temperature corresponds with a temperature a user has specified for the space 108. As an example, the temperature control device 102 may first determine a temperature difference between the temperature value and the setpoint temperature value for the space 108. The temperature control device 102 then determines a load demand value for reducing the temperature difference between the temperature value and the setpoint temperature value for the space 108. The load demand value may represent an energy efficiency ratio (EER) in British thermal units (BTUs) per hour and Watts or any other suitable units. In other examples, the temperature control device 102 may determine the load demand value using any other suitable technique.

At operation 206, the temperature control device 102 determines a load capacity value for the HVAC system 104. In one embodiment, the load capacity value for the HVAC system 104 may be stored in memory 112. In other embodiments, the temperature control device 102 may obtain the load capacity value for the HVAC system 104 from a remote server or a third-party server. For example, the temperature control device 102 may send a request that identifies the HVAC system 104 and/or components of the HVAC system 104 to a remote server. The remote server may use the identifiers from the request to determine or look up a load capacity value for the HVAC system 104. In response to identifying the load capacity value for the HVAC system 104, the remote server sends the load capacity value for the HVAC system 104 to the temperature control device 102. In other examples, the temperature control device 102 may determine the load capacity value for the HVAC system 104 using any other suitable technique.

At operation 208, the temperature control device 102 determines whether a load deficit event has been detected. Here, the temperature control device 102 compares the load demand value to the load capacity value for the HVAC system 104 to determine whether the load demand value is greater than the load capacity value for the HVAC system 104. The temperature control device 102 detects a load deficit event when the load demand value is greater than the load capacity value for the HVAC system 104.

The temperature control device 102 proceeds to operation 210 in response to determining that a load deficit event has not been detected. In this case, the temperature control device 102 proceeds to operation 210 to identify standard mode settings 122 to use for controlling the operation of the HVAC system 104. At operation 210, the temperature control device 102 operates the HVAC system 104 using standard mode settings 122. The temperature control device 102 identifies a standard mode setting 122 to use based on the difference between the load demand value and the load capacity value of the HVAC system 104. For example, the temperature control device 102 may determine a load deficit value that is equal to the difference between the load demand value and the load capacity value of the HVAC system 104. The temperature control device 102 may then identify an entry 130 from the HVAC control instructions 114 that closest matches the determined load deficit value. The temperature control device 102 then uses the standard mode setting 122 that is associated with the identified entry 130. In one example, the temperature control device 102 sends a trigger signal 124 to the IFC 402 to instruct the IFC 402 to operate one or more components of the HVAC system 104 using the identified standard mode setting 122. In another example, the temperature control device 102 sends a trigger signal 124 to the outdoor unit controller 548 to instruct the outdoor unit controller 548 to operate one or more components of the HVAC system 104 using the identified standard mode settings 122.

Returning to operation 208, the temperature control device 102 proceeds to operation 212 in response to determining that a load deficit event has been detected. In this case, the temperature control device 102 proceeds to operation 212 to identify boost mode settings 122 to use for controlling the operation of the HVAC system 104 since the temperature differential between the temperature value and the desired set point temperature value is too great to resolve using standard mode settings 122. At operation 212, the temperature control device 102 enables boost mode settings 122. By default, access to the boost mode settings 122 is restricted from users. By enabling the boost mode settings 122 the user is now able to use setting values that exceed the default or recommended value ranges for one or more components of the HVAC system 104, which were previously restricted. In one embodiment, the temperature control device 102 identifies a boost mode setting 122 to use based on the difference between the load demand value and the load capacity value of the HVAC system 104. For example, the temperature control device 102 may determine a load deficit value that is equal to the difference between the load demand value and the load capacity value of the HVAC system 104. The temperature control device 102 may then identify an entry 130 from the HVAC control instructions 114 that closest matches the determined load deficit value. The temperature control device 102 then uses the boost mode setting 122 that is associated with the identified entry 130.

After identifying a boost mode setting 122, the temperature control device 102 outputs a message requesting permission to operate the HVAC system 104 using the identified setting 122. In some embodiments, the temperature control device 102 may also output other information identifying the savings or benefits of using the boost mode settings 122 compared to standard mode settings 122. In some instances, the temperature control device 102 may output other types of information such as wear and tear information for using the boost mode settings 122 or any other suitable type of information. The temperature control device 102 then receives a response from a user indicating whether the user grants permission to operate the HVAC system 104 using the identified setting 122. In response to determining that the user has granted permission to operate the HVAC system 104 using the identified setting 122, the temperature control device 102 proceeds to operation 214 to apply the identified setting 122.

At operation 214, the temperature control device 102 operates the HVAC system 104 using boost mode settings 122. In one example, the temperature control device 102 sends a trigger signal 124 to the IFC 402 to instruct the IFC 402 to operate one or more components of the HVAC system 104 using the identified boost mode setting 122. In this example, sending the trigger signal 124 to the IFC 402 may trigger the IFC 402 to adjust a speed of a compressor, adjust a speed of a heat pump, and/or adjust any other suitable parameters for one or more components of the HVAC system 104. In another example, the temperature control device 102 sends a trigger signal 124 to the outdoor unit controller 548 to instruct the outdoor unit controller 548 to operate one or more components of the HVAC system 104 using the identified boost mode setting 122.

In some embodiments, the temperature control device 102 may send trigger signals 124 to one or more components of the HVAC system 104 control their operation using the identified boost mode settings 122. For example, the temperature control device 102 may send a trigger signal to a compressor (e.g. compressor 506) to control the speed of the compressor based on the identified boost mode settings 122. In other examples, the temperature control device 102 may send trigger signal 124 to any other component or combination of components based on the identified boost mode settings 122.

In some embodiments, the temperature control device 102 may revert the HVAC system 104 back to using standard mode 126 settings 122 after using boost mode 128 settings 122 for a predetermined amount of time. For example, after a predetermined amount of time has elapsed from sending the trigger signal 124 instructing the IFC 402 or outdoor unit controller 548 to operate the HVAC system 104 using boost mode settings 122, the temperature control device 102 identifies a standard mode setting 122 to use instead of the boost mode setting 122. In this case, the temperature control device 102 sends another trigger signal 124 to the IFC 402 or the outdoor unit controller 548 to instruct the IFC 402 or outdoor unit controller 548 to use the identified standard mode settings 122. This process allows the boost mode 128 to be disabled after a predetermined amount of time which avoids any unnecessary wear and tear on the components of the HVAC system 104.

Hardware Configuration for a Temperature Control Device

Figure 3:
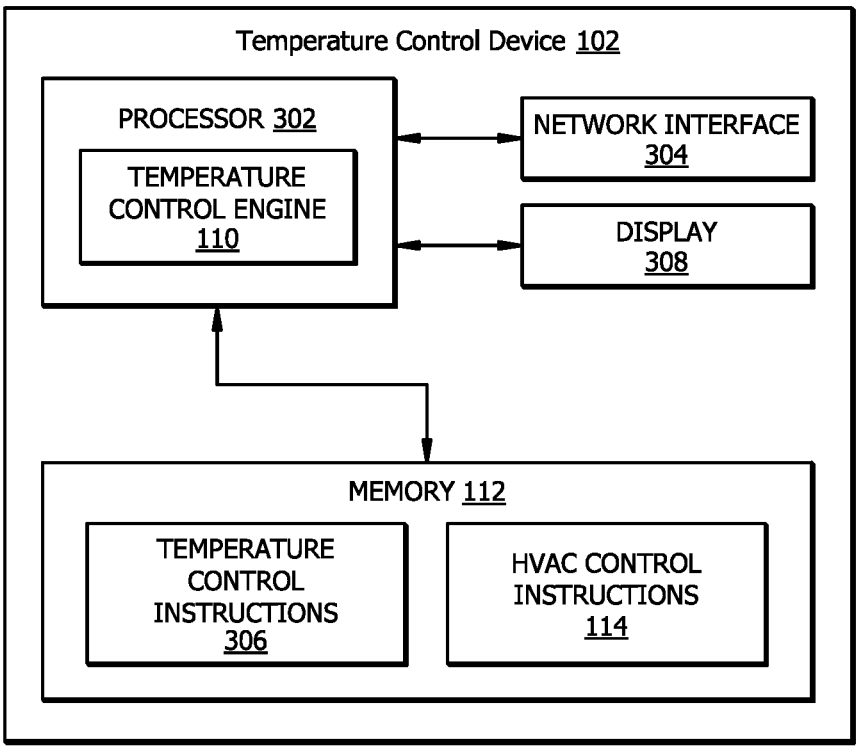
FIG. 3 is an embodiment of a temperature control device for the HVAC system.

FIG. 3 is an embodiment of temperature control device 102 (e.g. thermostat) of a control system 100. As an example, the temperature control device 102 comprises a processor 302, a memory 112, a display 308, and a network interface 304. The temperature control device 102 may be configured as shown or in any other suitable configuration.

Processor

The processor 302 comprises one or more processors operably coupled to the memory 112. The processor 302 is any electronic circuitry including, but not limited to, state machines, one or more central processing unit (CPU) chips, logic units, cores (e.g. a multi-core processor), field-programmable gate array (FPGAs), application-specific integrated circuits (ASICs), or digital signal processors (DSPs). The processor 302 may be a programmable logic device, a microcontroller, a microprocessor, or any suitable combination of the preceding. The processor 302 is communicatively coupled to and in signal communication with the memory 112, display 308, and the network interface 304. The one or more processors are configured to process data and may be implemented in hardware or software. For example, the processor 302 may be 8-bit, 16-bit, 32-bit, 64-bit, or of any other suitable architecture. The processor 302 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components.

The one or more processors are configured to implement various instructions. For example, the one or more processors are configured to execute temperature control instructions 306 to implement the temperature control engine 110. In this way, processor 302 may be a special-purpose computer designed to implement the functions disclosed herein. In an embodiment, the temperature control engine 110 is implemented using logic units, FPGAs, ASICs, DSPs, or any other suitable hardware. The temperature control engine 110 is configured to operate as described in FIGS. 1-2. For example, the temperature control engine 110 may be configured to perform the operations of process 200 as described in FIG. 2.

Memory

The memory 112 is operable to store any of the information described above with respect to FIGS. 1-2 along with any other data, instructions, logic, rules, or code operable to implement the function(s) described herein when executed by the processor 302. The memory 112 comprises one or more disks, tape drives, or solid-state drives, and may be used as an over-flow data storage device, to store programs when such programs are selected for execution, and to store instructions and data that are read during program execution. The memory 112 may be volatile or non-volatile and may comprise a read-only memory (ROM), random-access memory (RAM), ternary content-addressable memory (TCAM), dynamic random-access memory (DRAM), and static random-access memory (SRAM).

The memory 112 is operable to store temperature control instructions 306, an HVAC control instructions 114, and/or any other data or instructions. The temperature control instructions 306 may comprise any suitable set of instructions, logic, rules, or code operable to execute the temperature control engine 110. The HVAC control instructions 114 are configured similar to the HVAC control instructions 114 described in FIGS. 1-2, respectively.

Display

The display 308 is a graphical user interface that is configured to present visual information to a user using graphical objects. Examples of the display 308 include, but are not limited to, a liquid crystal display (LCD), a liquid crystal on silicon (LCOS) display, a light-emitting diode (LED) display, an active-matrix OLED (AMOLED), an organic LED (OLED) display, a projector display, or any other suitable type of display as would be appreciated by one of ordinary skill in the art.

Network Interface

The network interface 304 is configured to enable wired and/or wireless communications. The network interface 304 is a hardware device that is configured to communicate data between the temperature control device 102 and other devices (e.g. HVAC system 104), systems, or domains. For example, the network interface 304 may comprise an NFC interface, a Bluetooth interface, a Zigbee interface, a Z-wave interface, an RFID interface, a WIFI interface, a LAN interface, a WAN interface, a PAN interface, a modem, a switch, or a router. The processor 302 is configured to send and receive data using the network interface 304. The network interface 304 may be configured to use any suitable type of communication protocol as would be appreciated by one of ordinary skill in the art.

HVAC System Configuration with a Furnace

Figure 4:
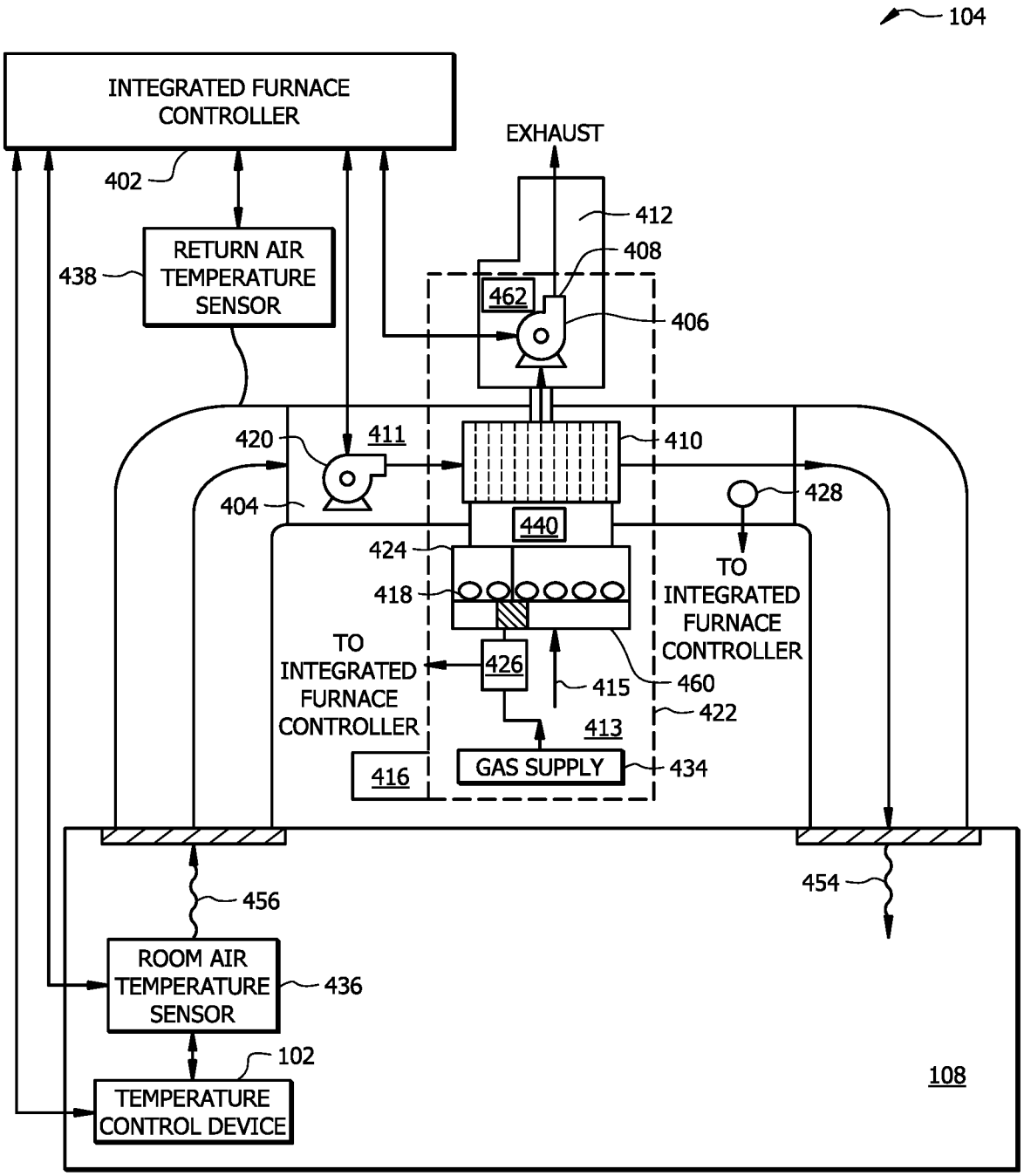
FIG. 4 is a schematic diagram of an embodiment of an HVAC system configured to integrate with the temperature control device.

FIG. 4 is a schematic diagram of an embodiment of an HVAC system 104 configured to integrate with a control system 100. The HVAC system 104 conditions air for delivery to an interior space of a building or home. In some embodiments, the HVAC system 104 is a rooftop unit (RTU) that is positioned on the roof of a building and the conditioned air is delivered to the interior of the building. In other embodiments, portions of the system may be located within the building and a portion outside the building. The HVAC system 104 may also include cooling elements that are not shown here for convenience and clarity. The HVAC system 104 may be configured as shown in FIG. 4 or in any other suitable configuration. For example, the HVAC system 104 may include additional components or may omit one or more components shown in FIG. 4.

The HVAC system 104 comprises a circulation fan 420, a heating unit 422, a return air temperature sensor 438, a discharge air temperature (DAT) sensor 428, a room air temperature sensor 436, the thermostat or temperature control device 102, and an IFC 402. Portions of the HVAC system 104 may be contained within a cabinet 404. In some embodiments, the IFC 402 may be included within the cabinet 404. The HVAC system 104 is configured to generate heat and to provide the generated heat to a conditioned room or space 108 to control the temperature within the space 108. The HVAC system 104 is configured to employ multi-stage or modulating heating control which allows the HVAC system 104 to configure itself to control the discharge air temperature and to adjust the speed of the circulation fan 420 to fine-tine the discharge air temperature. In one embodiment, the HVAC system 104 may be configured to achieve a three to one (3:1), a five to one (5:1) turndown ratio, or any other suitable turndown ratio. A turndown ratio is the operating range of the HVAC system 104, for example, the ratio of the maximum output to the minimum output. Alternatively, the HVAC system 104 may be configured to achieve any other turndown ratio as would be appreciated by one of ordinary skill in the art upon viewing this disclosure.

The circulation fan 420 is a variable speed unit blower that is operably coupled to the IFC 402. The IFC 402 may adjust the speed of the circulation fan 420 to control the discharge air temperature or temperature rise of the HVAC system 104. The circulation fan 420 may be configured to operate at 10%, 25%, 50%, 75%, 100%, or any other suitable percentage of the maximum speed of the circulation fan 420. The circulation fan 420 may be located near an air intake 411 of the cabinet 404. The circulation fan 420 is configured to circulate air between the cabinet 404 and the space 108. The circulation fan 420 is configured to pull return air 456 from the space 108, to provide the return air 456 to the heating unit 422 to heat the air, and to provide the heated air as supply or discharge air 454 to the space 108.

The heating unit 422 comprises a burner assembly 424 having a plurality of burners 418, a flame sensor 440, a heat exchanger 410, a CAI 406, a pressure switch 462, a condensate drain 416, a gas valve 426, and a gas supply 434. In one embodiment, the heating unit 422 is a single furnace. The heating unit 422 is configured to generate heat for heating air that is communicated from the circulation fan 420 to the space 108. The heating unit 422 is configurable between a plurality of configurations to adjust the amount of heat generated by the heating unit 422. For example, the heating unit 422 may be configured to generate 25% 53%, 64%, 75%, 100%, or any other suitable percentage of the maximum heat output of the heating unit 422.

The burner assembly 424 comprises a gas manifold 460 and a plurality of burners 418. The burners 418 are configured for burning a combustible fuel-air mixture (e.g. gas-air mixture) and to provide a combustion product to the heat exchanger 410. The burners 418 are connected to the fuel source or gas supply 434 via the gas valve 426. The burners 418 may be configured to stay active (i.e. on) during operation or to pulse (i.e. toggle between on and off) during operation. A burner 418 configured to stay active during operation is referred to as a constant burner 418 and a burner 418 configured to pulse during operation is referred to as a pulsed burner 418. A pulsed burner 418 has an adjustable duty cycle so that the percentage of the time period that the pulsed burner 418 is active is adjustable. The pulsed burner 418 is configured to be toggled or modulated using pulse width modulation (PWM). For example, a pulsed burner 418 may be modulated by the IFC 402 using pulse width modulation.

The flame sensor 440 is configured to detect a flame inside of the burner assembly 424. For example, the flame sensor 440 may be configured to generate an electrical signal (e.g. electrical current) in response to heat from a flame within the burner assembly 424. In this configuration, the flame sensor 440 will output an electrical signal when a flame is detected. Otherwise, the flame sensor 440 will not output an electrical signal when a flame is not detected.

The condensate drain 416 is configured to provide an exit route for moisture and fluid from the heating unit 422. Moisture from the heating unit 422 may be collected from flue gas condensation and drained from the heating unit 422 via the condensate drain 416.

The gas valve 426 is configured to allow or disallow gas flow between the gas supply 434 and the gas manifold 460. For example, the gas valve 426 may be operable between an off configuration that substantially blocks gas flow between the gas supply 434 and the gas manifold 460, a low-fire rate configuration that allows a first flow rate of gas to be supplied to the burners 418, and a high-fire rate configuration that allows a second flow rate of gas that is higher than the first flow rate to be supplied to the burners 418. The gas supply 434 is configured to store and provide fuel or gas for the heating unit 422. The gas supply 434 is configured to store and provide any suitable combustible fuel or gas as would be appreciated by one of ordinary skill in the art upon viewing this disclosure.

The heat exchanger 410 comprises a plurality of passageways, for example, a tubular heat exchanger element for each burner 418. The heat exchanger 410 is configured to receive the combustion product from the burner assembly 424 and to use the combustion product to heat air that is blown across the heat exchanger 410 by the circulation fan 420.

The CAI 406 is configured to draw combustion air 415 into the burner assembly 424 (i.e. the burners 418) using an induced draft and is also used to exhaust waste products of combustion from the HVAC system 104 through a vent 408. In an embodiment, the CAI 406 is operable between two speed settings, for example, a low speed that corresponds with the low-fire mode of operation for the burners 418 and a high speed that corresponds with the high-fire mode of operation for the burners 418. The CAI 406 is configured such that the low speed and the high speed correspond to the low-fire gas rate and the high-fire gas rate, respectively, to provide gas-fuel-mixture for the low-fire and high-fire modes of the heat exchanger 410. In one embodiment, the air-fuel mixture is substantially constant through the various heating unit 422 configurations.

The pressure switch 462 is configured to sense negative pressure generated by the CAI 406 while the CAI 406 is operating. The pressure switch 462 is configured to be normally open and to close in response to an increase in differential pressure above a predetermined threshold value.

The return air temperature sensor 438 is configured to determine a return air temperature for the HVAC system 104. For example, the return air temperature sensor 438 may be a temperature sensor configured to determine the ambient temperature of air that is returned to or entering the HVAC system 104 and to provide the temperature data to the IFC 402. In one embodiment, the return air temperature sensor 438 is located in the cabinet 404. Alternatively, the return air temperature sensor 438 may be positioned in other locations to measure the return air temperature for the HVAC system 104. For example, the return air temperature sensor 438 may be positioned in a duct between the cabinet 604 and the space 108.

An example of the DAT sensor 428 includes, but is not limited to, a 10K Negative Temperature Coefficient (NTC) sensor. The DAT sensor 428 is configured to determine a discharge or supply air temperature of the HVAC system 104. For example, the DAT sensor 428 may be a temperature sensor configured to determine the ambient temperature of air that is discharged from the HVAC system 104 and to provide the temperature data to the IFC 402. In one embodiment, the DAT sensor 428 is located in the cabinet 404. Alternatively, the DAT sensor 428 may be positioned in other locations to measure the discharge air temperature of the HVAC system 104. For example, the DAT sensor 428 may be positioned in a duct between the cabinet 404 and the space 108.

The room air temperature sensor 436 is configured to determine an air temperature for the space 108. For example, the room air temperature sensor 436 may be a temperature sensor configured to determine the ambient temperature of the air of the space 108 and to provide the temperature data to the temperature control device 102. The room air temperature sensor 436 may be located anywhere within the space 108. The temperature control device 102 may be a two-stage thermostat or any suitable thermostat employed in an HVAC system 104 to generate heating calls based on a temperature setting as would be appreciated by one of ordinary skill in the art upon viewing this disclosure. The temperature control device 102 is configured to allow a user to input a desired temperature or temperature set point for a designated area or zone such as the space 108.

The IFC 402 may be implemented as one or more CPU chips, logic units, cores (e.g. as a multi-core processor), FPGAs, ASICs, or DSPs. The IFC 402 is operably coupled to and in signal communication with the temperature control device 102, the room air temperature sensor 436, the return air temperature sensor 438, the DAT sensor 428, the gas valve 426, the circulation fan 420, and the CAI 406 via one or more input/output (I/O) ports. The IFC 402 is configured to receive and transmit electrical signals among one or more of the temperature control device 102, the room air temperature sensor 436, the return air temperature sensor 438, the DAT sensor 428, the gas valve 426, the circulation fan 420, and the CAI 406. The electrical signals may be used to send and receive data or to operate and control one or more components of the HVAC system 104. For example, the IFC 402 may transmit electrical signals (e.g. control signals) to operate the circulation fan 420 and to adjust the speed of the circulation fan 420. The IFC 402 may be operably coupled to one or more other devices or pieces of HVAC equipment (not shown). The IFC 402 is configured to process data and may be implemented in hardware or software.

HVAC System Configuration with a Variable Speed Compressor

Figure 5:
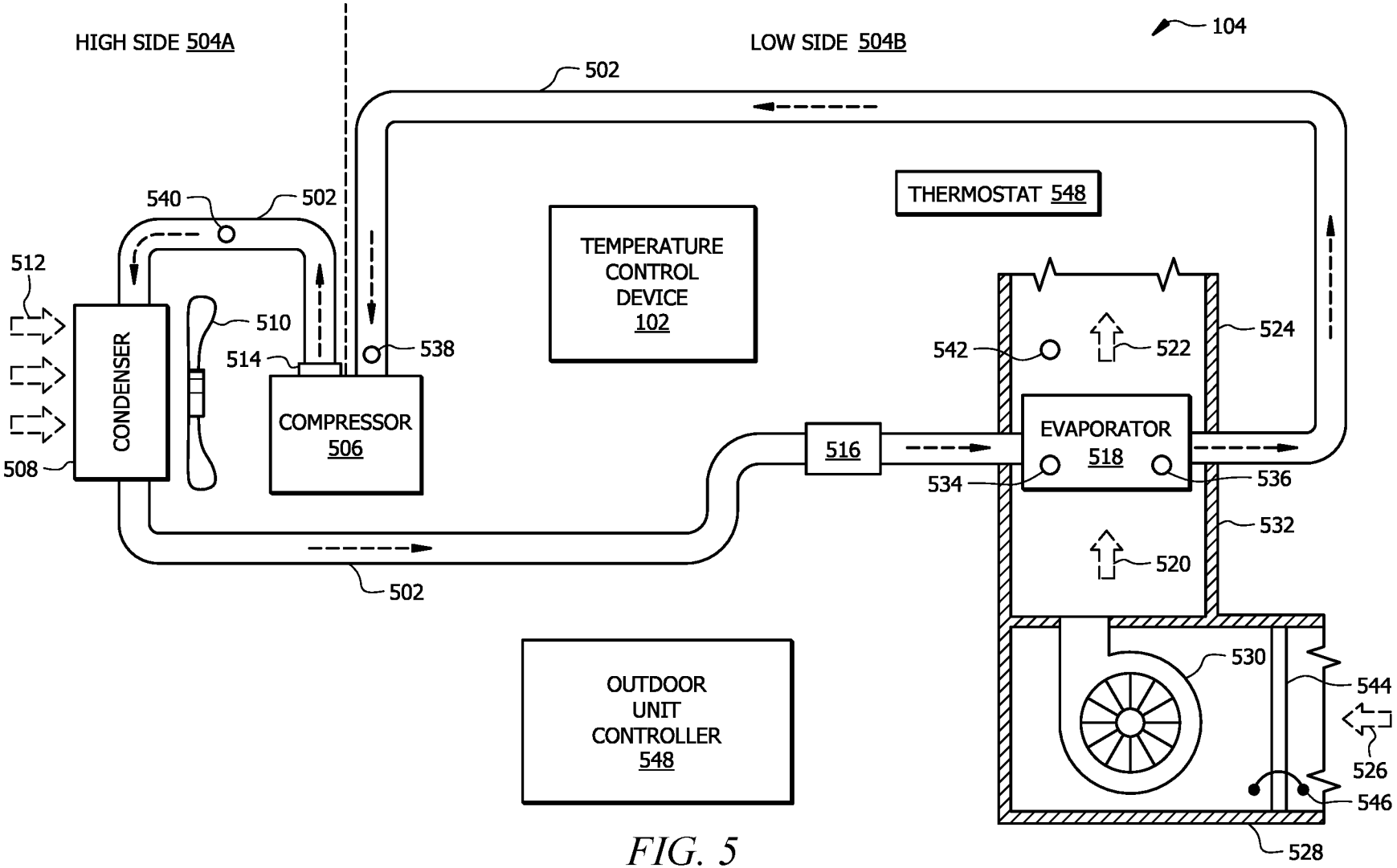
FIG. 5 is a schematic diagram of another embodiment of an HVAC system configured to integrate with the temperature control device.

FIG. 5 is a schematic diagram of an embodiment of an HVAC system 104 configured to integrate with a control system 100. In this example, the HVAC system 104 is configured to condition air for delivery to a space 108. The space 108 may be, for example, a room, a house, an office building, a warehouse, or the like. In some embodiments, the HVAC system 104 is a rooftop unit (RTU) that is positioned on the roof of a building, and conditioned air 522 is delivered to the interior of the building. In other embodiments, portion(s) of the HVAC system 104 may be located within the building and portion(s) outside the building. The HVAC system 104 may be configured as shown in FIG. 5 or in any other suitable configuration. For example, the HVAC system 104 may include additional components or may omit one or more components shown in FIG. 5.

The HVAC system 104 comprises a working-fluid conduit subsystem 502, a compressor 506, a condenser 508, an outdoor fan 510, a check valve 514, an expansion device 516, an evaporator 518, a blower 530, sensors 534, 536, 538, 540, 542, 546, a return air filter 544, one or more thermostats 548, an outdoor unit controller 548, and the temperature control device 102.

The working-fluid conduit subsystem 502 facilitates the movement of a refrigerant through a refrigeration cycle such that the refrigerant flows as illustrated by the dashed arrows in FIG. 5. The working-fluid conduit subsystem 502 includes conduit, tubing, and the like that facilitates the movement of refrigerant between components of the HVAC system 104. The refrigerant may be any acceptable refrigerant including, but not limited to, fluorocarbons (e.g. chlorofluorocarbons), ammonia, non-halogenated hydrocarbons (e.g. propane), hydroflurocarbons (e.g. R-410A), or any other suitable type of refrigerant. In some cases, the refrigerant may be flammable or pose a risk to occupants of the space cooled by the HVAC system 104.

The HVAC system 104 generally includes a "high side" or high-pressure subsystem 504A and a "low side" or low-pressure subsystem 504B. The high-pressure subsystem 504A generally includes components and portions of the working-fluid conduit subsystem 502 that contain refrigerant at a relatively high pressure (e.g., after the refrigerant is pressurized, or compressed, by the compressor 506. The low-pressure subsystem 504B includes components and portions of the working-fluid conduit subsystem 502 that contain refrigerant at a relatively low pressure (e.g., after the refrigerant is expanded by the expansion device 516). In some cases, the high-pressure subsystem 504A is primarily located outdoors, while the low-pressure subsystem 504B may be located indoors.

The HVAC system 104 includes a compressor 506, a condenser 508, and a fan 510. In some embodiments, the compressor 506, condenser 508, and fan 510 are combined in an outdoor unit while at least certain other components of the HVAC system 104 may be located indoors (e.g., components of the low-pressure subsystem 504B). The compressor 506 is coupled to the working-fluid conduit subsystem 502 and compresses (i.e., increases the pressure of) the refrigerant. The compressor 506 may be a variable-speed or multiple stage compressor. A variable-speed compressor is generally configured to operate at different speeds to increase the pressure of the refrigerant to keep the refrigerant moving along the working-fluid conduit subsystem 502. In the variable-speed compressor configuration, the speed of compressor 106 can be modified to adjust the cooling capacity of the HVAC system 104. Meanwhile, in the multi-stage compressor configuration, one or more compressors can be turned on or off to adjust the cooling capacity of the HVAC system 104.

The compressor 506 is in signal communication with the temperature control device 102 using wired and/or wireless connection. The temperature control device 102 provides commands or signals to control operation of the compressor 506 and/or receives signals from the compressor 506 corresponding to a status of the compressor 506. For example, the temperature control device 102 may transmit signals to adjust compressor speed and/or staging. The temperature control device 102 may operate the compressor 506 in different modes corresponding, for example, to an operating mode indication (e.g., a heating, cooling, or diagnostic mode), to load conditions (e.g., the amount of cooling or heating required by the HVAC system 104), to a difference between a setpoint temperature and an indoor air temperature, and the like.

A check valve 514 may be positioned at the outlet of the compressor 506. The check valve prevents backflow of refrigerant into the compressor 506 when the compressor 506 is not operated (e.g., as in during at least a portion of the diagnostic operations described in this disclosure). The check valve 514 may be operated based on a pressure of refrigerant in the conduit 502 connecting the compressor 506 to the condenser 508 relative to the pressure of refrigerant in the compressor 506. For example, if the pressure in the conduit 502 exceeds the pressure in the condenser 506, then the check valve 514 may automatically close to prevent backflow of refrigerant into the compressor 506.

The condenser 508 is generally located downstream of the compressor 506 and is configured, when the HVAC system 104 is operating in a cooling mode, to remove heat from the refrigerant. The fan 510 is configured to move air 512 across the condenser 508. For example, the fan 510 may be configured to blow outside air through the condenser 508 to help cool the refrigerant flowing therethrough. In the cooling mode, the compressed, cooled refrigerant flows from the condenser 508 toward the expansion device 516.

The expansion device 516 is coupled to the working-fluid conduit subsystem 502 downstream of the condenser 508 and is configured to remove pressure from the refrigerant. The expansion device 516 is generally a controllable valve positioned in refrigerant conduit of the working-fluid conduit subsystem 502 that connects the condenser 508 to the evaporator 518. In this way, the refrigerant is delivered to the evaporator 518 and receives heat from airflow 520 to produce a conditioned airflow 522 that is delivered by a duct subsystem 524 to the conditioned space. In general, the expansion device 516 may be a valve such as an expansion valve or a flow control valve (e.g., a thermostatic expansion valve) or any other suitable valve for removing pressure from the refrigerant while, optionally, providing control of the rate of flow of the refrigerant. In some cases, the expansion device 516 may include two devices, for example, a thermostatic expansion valve (TXV) with a solenoid valve located upstream of the TXV. The expansion device 516 may be in communication with the temperature control device 102 (e.g., via wired and/or wireless communication) to receive control signals for opening and/or closing associated valves and/or provide flow measurement signals corresponding to the rate of refrigerant flow through the working-fluid conduit subsystem 502.

The evaporator 518 is generally any heat exchanger configured to provide heat transfer between air flowing through (or across) the evaporator 518 (i.e., air 520 contacting an outer surface of one or more coils of the evaporator 518) and refrigerant passing through the interior of the evaporator 518, when the HVAC system 104 is operated in the cooling mode. The evaporator 518 may include one or more circuits. The evaporator 518 is fluidically connected to the compressor 506, such that refrigerant generally flows from the evaporator 518 to the compressor 506. A portion of the HVAC system 104 is configured to move air 520 across the evaporator 518 and out of the duct subsystem 524 as conditioned air 522. In some embodiments, the HVAC system 104 may include a heating element (not shown for clarity and conciseness). The heating element is generally any device for heating the flow of air 520 and providing heated air 522 to the conditioned space, when the HVAC system 104 operates in a heating mode.

Return air 526, which may be air returning from the building, air from outside, or some combination, is pulled into a return duct 528. An inlet or suction side of the blower 530 pulls the return air 526. The return air 526 may pass through an air filter 544. The air filter 544 is generally a piece of porous material that removes particulates from the return air 526. As described further below, sensor(s) 546 may be located on each side of the air filter 544 and configured to measure an air pressure drop across the air filter 544. The air pressure drop may be used to determine when the air filter 544 is blocked by accumulated particulates and should be changed. The blower 530 discharges air 520 into a duct 532 such that air 520 crosses the evaporator 518 to produce conditioned air 522. The blower 530 is any mechanism for providing a flow of air through the HVAC system 104. For example, the blower 530 may be a constant-speed or variable-speed circulation blower or fan. Examples of a variable-speed blower include, but are not limited to, belt-drive blowers controlled by inverters, direct-drive blowers with electronic commuted motors (ECM), or any other suitable type of blower.

The blower 530 is in signal communication with the temperature control device 102 using any suitable type of wired and/or wireless connection. The temperature control device 102 is configured to provide commands and/or signals to the blower 530 to control its operation. For example, the temperature control device 102 may receive an indication of the blower status indicating whether the blower is operating as intended. Generally, when functioning as intended, the blower 530 provides airflow 520 across the evaporator 518, but the blower may not provide the appropriate or expected airflow 520 when the blower 530 is not functioning as intended.

The HVAC system 104 includes one or more of the sensors 534, 536, 538, 540, 542, 546 illustrated in FIG. 5. The sensors 534, 536, 538, 540, 542, 546 are in wired and/or wireless signal communication with temperature control device 102. Signals corresponding to the properties measured by sensors 534, 536, 538, 540, 542, 546 are provided to the temperature control device 102. In some embodiments, one or more of the sensors 534, 536, 538, 540, 542, 546 or another sensor integrated with the HVAC system 102 may be an internet-of-things (IOT) device. For example, one or more of the sensors 534, 536, 538, 540, 542, 546 may communicate wirelessly with the temperature control device 102 (e.g., via a wireless network associated with the conditioned space). In other examples, the HVAC system 104 may include other sensors (not shown for clarity and conciseness) positioned and configured to measure any other property associated with operation of the HVAC system 104 (e.g., the temperature and/or relative humidity of air at one or more locations within the conditioned space and/or outdoors).

Sensors 534 and 536 are positioned proximate or inside the evaporator 518 to measure properties of the refrigerant flowing therethrough. For example, sensors 534, 536 may measure temperatures and/or pressures of the refrigerant at different points in the evaporator 518. The measured temperatures and/or pressures may be used by the temperature control device 102 to determine a superheat (SH). SH is the difference between the temperature of refrigerant exiting the evaporator 518 (e.g., measured by sensor 536) and the vaporization temperature of the refrigerant in the evaporator 518 (e.g., measured via temperature or pressure measured by sensor 534). For example, the first evaporator sensor 534 may be positioned and configured to measure a saturated suction temperature (SST) of the refrigerant in the evaporator 518, while the second sensor 536 may be positioned and configured to measure a superheated vapor temperature of the refrigerant in the evaporator 518.

Sensor 538 is located proximate the inlet of the compressor 506 or in the portion of the working-fluid conduit 502 leading into the inlet of the compressor 506. While in the example of FIG. 5, the sensor 538 is shown relatively near the inlet of the compressor 506, this sensor 538 could be located further upstream from the inlet of the compressor 506 (e.g., nearer the outlet of the evaporator 518).

Sensor 540 measures a high-side pressure. The high-side pressure is the pressure of the refrigerant in the high-pressure subsystem 504A of the HVAC system 104. While in the example of FIG. 5, the sensor 540 is shown between the outlet of the compressor 506 and the inlet of the condenser 508, this sensor 540 could be located at another position in the high-pressure subsystem 504A of the HVAC system 104 (e.g., proximate or downstream of the outlet of the condenser 508).

Sensor 542 is positioned and configured to measure a discharge air temperature of airflow 522 or a temperature of air provided to the space conditioned by the HVAC system 104. Sensor(s) 546 may be located on each side of the air filter 544 and configured to measure an air pressure drop across the air filter 544. The air pressure drop may be used to determine when the air filter 544 is blocked and/or should be changed.

The HVAC system 104 includes one or more thermostats 548, for example, located within the conditioned space (e.g. a room or building). The thermostat(s) 548 are generally in signal communication with the temperature control device 102 using any suitable type of wired and/or wireless connection. In some embodiments, one or more functions of the temperature control device 102 may be performed by the thermostat(s) 548. For example, the thermostat 548 may include the temperature control device 102. The thermostat (s) 548 may include one or more single-stage thermostats, one or more multi-stage thermostat, or any suitable type of thermostat(s). The thermostat(s) 548 are configured to allow a user to input a desired temperature or temperature setpoint for the conditioned space and/or for a designated space or zone, such as a room, in the conditioned space. The thermostat(s) generally include or are in communication with a sensor for measuring an indoor air temperature (e.g., sensor 142).

The outdoor unit controller 548 may be implemented as one or more CPU chips, logic units, cores (e.g. as a multi-core processor), FPGAs, ASICs, or DSPs. The outdoor unit controller 548 is operably coupled to and in signal communication with the temperature control device 102, the compressor 506, the condenser 508, the outdoor fan 510, the check valve 514, the expansion device 516, the evaporator 518, the blower 530, the sensors 534, 536, 538, 540, 542, 546, the return air filter 544, and the one or more thermostats 548. The outdoor unit controller 548 is configured to receive and transmit electrical signals among one or more of the temperature control device 102, the compressor 506, the condenser 508, the outdoor fan 510, the check valve 514, the expansion device 516, the evaporator 518, the blower 530, the sensors 534, 536, 538, 540, 542, 546, the return air filter 544, and the one or more thermostats 548. The electrical signals may be used to send and receive data or to operate and control one or more components of the HVAC system 104. For example, the outdoor unit controller 548 may transmit electrical signals (e.g. control signals) to operate the compressor 506 and outdoor fan 510 and to adjust the speed of the compressor 506 and outdoor fan 510. The outdoor unit controller 548 may be operably coupled to one or more other devices or pieces of HVAC equipment (not shown). The outdoor unit controller 548 is configured to process data and may be implemented in hardware or software.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A Heating, Ventilation, and Air Conditioning (HVAC) control system, comprising:

an HVAC controller configured to send control signals for operating one or more components of an HVAC system; and a temperature control device operably coupled to the HVAC controller, comprising:

a memory operable to store HVAC control instructions, wherein the HVAC control instructions comprise:

a first plurality of settings for the HVAC system, wherein each setting in the first plurality of settings controls the operation of the one or more components of the HVAC system; and a second plurality of settings for the HVAC system, wherein:

each setting in the second plurality of settings controls the operation of the one or more components of the HVAC system; and access to the second plurality of setting for the HVAC system is restricted for a user by default; and a processor operably coupled to the memory, configured to:

receive a temperature value;

determine a load demand value based on the temperature value;

determine a load capacity value for the HVAC system;

determine the load demand value is greater than the load capacity value for the HVAC system;

identify a first particular setting from among the second plurality of settings for the HVAC system in response to determining that the load demand value is greater than the load capacity value for the HVAC system;

output a message requesting permission to operate the HVAC system using the first particular setting;

receive a response approving permission to operate the HVAC system using the first particular setting; and send a first trigger signal to the HVAC controller to operate the one or more components of the HVAC system using the first particular setting.

2. The system of claim 1, wherein identifying the first particular setting from among the second plurality of settings for the HVAC system comprises:

determining a load deficit value corresponding with a difference between the load demand value and the load capacity value; and identifying the first particular setting that is mapped to the load deficit value in the HVAC control instructions.

3. The system of claim 1, wherein the received temperature value is a current temperature value.

4. The system of claim 1, wherein the received temperature value is a forecasted temperature value.

5. The system of claim 1, wherein sending the first trigger signal to the HVAC controller triggers the HVAC controller to adjust a speed of a compressor.

6. The system of claim 1, wherein sending the first trigger signal to the HVAC controller triggers the HVAC controller to adjust a speed of a heat pump.

7. The system of claim 1, wherein the processor is further configured to:

identify a second particular setting from among the first plurality of settings for the HVAC system;

determine a predetermined amount of time has elapsed since sending the first control signal; and send a second trigger signal to the HVAC controller to operate the one or more components of the HVAC system using the second particular setting in response to determining that the predetermined amount of time has elapsed since sending the first control signal.

8. A Heating, Ventilation, and Air Conditioning (HVAC) control method, comprising:

receiving a temperature value;

determining a load demand value based on the temperature value;

determining a load capacity value for an HVAC system;

determining the load demand value is greater than the load capacity value for the HVAC system;

identifying a first particular setting from among a first plurality of settings for the HVAC system in response to determining that the load demand value is greater than the load capacity value for the HVAC system, wherein:

each setting in the first plurality of settings controls the operation of the one or more components of the HVAC system; and access to the first plurality of setting for the HVAC system is restricted for a user by default;

outputting a message requesting permission to operate the HVAC system using the first particular setting;

receiving a response approving permission to operate the HVAC system using the first particular selling; and sending a first trigger signal to an HVAC controller to operate the one or more components of the HVAC system using the first particular setting.

9. The method of claim 8, wherein identifying the first particular setting from among the second plurality of settings for the HVAC system comprises;

determining a load deficit value corresponding with a difference between the load demand value and the load capacity value; and identifying the first particular setting that is mapped to the load deficit value in the HVAC control instructions.

10. The method of claim 8, wherein the received temperature value is a current temperature value.

11. The method of claim 8, wherein the received temperature value is a forecasted temperature value.

12. The method of claim 8, wherein sending the first trigger signal to the HVAC controller triggers the HVAC controller to adjust a speed of a compressor.

13. The method of claim 8, wherein sending the first trigger signal to the HVAC controller triggers the HVAC controller to adjust a speed of a heat pump.

14. The method of claim 8, further comprising:

identifying a second particular setting from among the first plurality of settings for the HVAC system;

determining a predetermined amount of time has elapsed since sending the first control signal; and sending a second trigger signal to the HVAC controller to operate the one or more components of the HVAC system using the second particular setting in response to determining that the predetermined amount of time has elapsed since sending the first control signal.

15. A temperature control device, comprising:

a memory operable to store Heating, Ventilation, and Air Conditioning (HVAC) control instructions, wherein the HVAC control instructions comprise:

a first plurality of settings for the HVAC system, wherein each setting in the first plurality of settings controls the operation of the one or more components of the HVAC system; and a second plurality of settings for the HVAC system, wherein:

each setting in the second plurality of settings controls the operation of the one or more components of the HVAC system; and access to the second plurality of setting for the HVAC system is restricted for a user by default; and a processor operably coupled to the memory, configured to:

receive a temperature value;

determine a load demand value based on the temperature value;

determine a load capacity value for the HVAC system;

determine the load demand value is greater than the load capacity value for the HVAC system;

identify a first particular setting from among the second plurality of settings for the HVAC system in response to determining that the load demand value is greater than the load capacity value for the HVAC system;

output a message requesting permission to operate the HVAC system using the first particular setting;

receive a response approving permission to operate the HVAC system using the first particular setting; and send a first trigger signal to an HVAC controller to operate the one or more components of the HVAC system using the first particular setting.

16. The device of claim 15, wherein identifying the first particular setting from among the second plurality of settings for the HVAC system comprises;

determining a load deficit value corresponding with a difference between the load demand value and the load capacity value; and identifying the first particular setting that is mapped to the load deficit value in the HVAC control instructions.

17. The device of claim 15, wherein the received temperature value is a current temperature value.

18. The device of claim 15, wherein the received temperature value is a forecasted temperature value.

19. The device of claim 15, wherein sending the first trigger signal to the HVAC controller triggers the HVAC controller to adjust a speed of at least one of a compressor or a heat pump.

20. The device of claim 15, wherein the processor is further configured to:

identify a second particular setting from among the first plurality of settings for the HVAC system;

determine a predetermined amount of time has elapsed since sending the first control signal; and send a second trigger signal to the HVAC controller to operate the one or more components of the HVAC system using the second particular setting in response to determining that the predetermined amount of time has elapsed since sending the first control signal.

* * * * *